US010415197B2

(12) United States Patent
Haydu

(10) Patent No.: US 10,415,197 B2
(45) **Date of Patent: *Sep. 17, 2019**

(54) BALLAST MATS AND METHODS OF FORMING THE SAME

(71) Applicant: VERSAFLEX, INC., Riverside, CA (US)

(72) Inventor: Joseph Haydu, Kansas City, KS (US)

(73) Assignee: VERSAFLEX, INC., Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/839,609

(22) Filed: Dec. 12, 2017

(65) Prior Publication Data

US 2018/0135260 A1 May 17, 2018

Related U.S. Application Data

(63) Continuation of application No. 15/632,104, filed on Jun. 23, 2017, now Pat. No. 9,869,065, which is a continuation-in-part of application No. 13/667,198, filed on Nov. 14, 2012, now Pat. No. 9,441,335.

(60) Provisional application No. 62/354,633, filed on Jun. 24, 2016.

(51) Int. Cl.

| | |
|---|---|
| ***E01D 19/00*** | (2006.01) |
| ***E01D 19/08*** | (2006.01) |
| ***E01B 27/02*** | (2006.01) |
| ***E01D 18/00*** | (2006.01) |

(Continued)

(52) U.S. Cl.

CPC ..... *E01D 19/083* (2013.01); *E01B 1/001* (2013.01); *E01B 2/003* (2013.01); *E01B 27/02* (2013.01); *E01D 18/00* (2013.01); *E01B 2204/01* (2013.01); *E01B 2204/07* (2013.01)

(58) Field of Classification Search

CPC .. E01B 2204/07; E01B 27/02; E01B 2204/01; E01B 1/001; E01B 2/003; E01D 19/083; E01D 18/00

USPC ..... 404/17, 31; 14/73, 77.1; 238/1–3, 238, 238/382

See application file for complete search history.

(56) References Cited

U.S. PATENT DOCUMENTS

| | | | | |
|---|---|---|---|---|
| 2,420,833 A | | 5/1947 | Monroe | |
| 3,110,981 A | * | 11/1963 | Larner | E01D 19/083 14/73 |
| 3,587,964 A | | 6/1971 | Cork | |

(Continued)

FOREIGN PATENT DOCUMENTS

| | | | | |
|---|---|---|---|---|
| GB | 1361791 | | 7/1974 | |
| GB | 2003003962 | * | 9/1977 | E01B 1/00 |

(Continued)

OTHER PUBLICATIONS

Office Action dated Jun. 7, 2018 in U.S. Appl. No. 15/240,603, 10 pages.

*Primary Examiner* — Raymond W Addie

(74) *Attorney, Agent, or Firm* — Knobbe, Martens, Olson & Bear, LLP

(57) ABSTRACT

A method and apparatus for coating transportation components such as a bridge deck with a coating. The coating includes a sealant and rubber mixed with a resin and a foaming agent. The apparatus includes a hopper for the rubber, a impingement gun for the resin and a gun assembly that combines the rubber and resin together at a combined nozzle for spraying.

21 Claims, 5 Drawing Sheets

(51) Int. Cl.
*E01B 1/00* (2006.01)
*E01B 2/00* (2006.01)

(56) References Cited

U.S. PATENT DOCUMENTS 4,069,182 A * 1/1978 McDonald ..... C08L 95/00 404/72
4,233,356 A * 11/1980 Jacobs ..... E01D 19/083 442/37
4,235,371 A 11/1980 Kohler
4,311,273 A 1/1982 Marsh
4,420,513 A 12/1983 Coke
4,500,037 A 2/1985 Braitsch
5,024,554 A 6/1991 Benneyworth
5,096,772 A 3/1992 Snyder
5,354,145 A * 10/1994 Sterner ..... E01C 23/06 404/107
5,411,352 A 5/1995 Eren
5,487,501 A 1/1996 Engst
5,525,416 A 6/1996 Katz
5,597,240 A * 1/1997 Fyfe ..... E01D 19/041 14/73.5
5,605,721 A 2/1997 Di Geronimo
5,738,279 A 4/1998 Ihle
6,055,693 A 5/2000 Lehr
6,060,555 A 5/2000 Wright
6,235,136 B1 5/2001 Kittson
6,896,964 B2 5/2005 Kvesic
7,687,104 B2 3/2010 Moon
7,896,255 B2 3/2011 Frenzel
8,104,245 B2 * 1/2012 Whelan ..... C09J 7/29 52/741.4
8,186,117 B2 * 5/2012 Eren ..... E01C 3/06 404/31
8,240,430 B2 8/2012 Downey
8,540,430 B2 9/2013 Janssen
9,121,142 B2 * 9/2015 Yano ..... E01D 19/083
2003/0091831 A1 5/2003 Mickey
2006/0032807 A1 2/2006 Sansalone
2008/0248887 A1 10/2008 Shaneour
2009/0152368 A1 6/2009 Frenzel
2010/0294847 A1 11/2010 Carels
2011/0070024 A1 * 3/2011 Kleiger ..... E01C 23/065 404/75
2012/0237296 A1 * 9/2012 Lemons ..... E01C 11/005 404/82
2012/0305663 A1 12/2012 Axton
2013/0206853 A1 8/2013 Robinson
2014/0259463 A1 * 9/2014 Chandra ..... E04C 3/28 14/6
2015/0040330 A1 2/2015 Kudrenski
2016/0138228 A1 * 5/2016 Rainwater ..... E01C 19/21 404/111

FOREIGN PATENT DOCUMENTS

GB 2003962 9/1978
RU 2360063 6/2009
RU 20100125863 5/2010

* cited by examiner

BALLAST MATS AND METHODS OF FORMING THE SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This application relates to ballast mats for use in railway and other transportation structures and methods and devices for forming the same.

Description of the Related Art

Railway structures, such as rail bridge decks, suffer deterioration from the corrosive effects of both natural and man-made agents. Freeze/thaw cycles, repeated day after day, year after year, also deteriorate the structures. Ballast, such as rock or gravel, can add additional challenges for rail bridge decks because of the punishing effects of its angularity. The tremendous pounding of high point loads adds to the challenge. Additionally, railway bridges are continually in a state of motion. Expansion and contraction caused by changes in thermal conditions, deflections caused by live loads, and longitudinal forces caused by railway traffic all combine to produce nearly continuous motion in the decks of railway bridges.

One method of protecting the railway structures is by using rigid ballast protection plates. Ballast protection plates can be used to help protect the railway structures against ballast and the harmful effects of corrosive elements, such as water, salts, and chemicals. Generally, the ballast protection plates are 4 foot by 8 foot sheets of ½" thick asphalt planking. The ballast protection plates are expensive, heavy, and cumbersome to work with. Additionally, railway structures may be uneven and the ballast protection plates may not sit flat. In such cases, grout, cement, or another type of patch would need to be applied to make the surfaces level, which can add further complications. Further, the ballast protection plates can allow water, chemicals, and other corrosive elements to seep through the ballast and corrode the railway structures.

A further issue that occurs with railroad and other transportation structures is that the heavy traffic causes vibration of the structure which can, over time, cause the structure to deteriorate. As an example, fasteners and welds holding the structure together can become compromised over long periods of time due to the vibration caused by heavy vehicles such as trains and heavy trucks travelling over the structure.

There is a need in the art for a railway protection system that can protect against ballast and the harmful effects of other corrosive elements without the drawbacks of rigid ballast protection plates. There is also a need for reducing vibrations being transmitted to the structure as a result of heavy vehicles travelling over the structure.

SUMMARY OF THE INVENTION

The aforementioned needs are satisfied, in one non-limiting example by a protective coating system for a railway bridge structure having ballast and a railway track structure comprising: a waterproof membrane disposed on the railway bridge structure, wherein the waterproof membrane forms a substantially waterproof seal on the railway bridge structure; a ballast protection coating adhered to the waterproof membrane, the ballast protection coating including a rubber compound and resin and a foaming agent, wherein the ballast protection coating is formed from a plurality of layers, wherein the ballast protection coating is compressible; and wherein the thickness of the waterproof membrane is less than the thickness of the ballast protection coating.

The aforementioned needs are satisfied in another non-limiting example by a protective coating system for a railway structure comprising: a waterproof membrane disposed on the railway structure; and a ballast mat further comprising, a ballast protection coating disposed on the waterproof membrane, wherein the ballast protection coating is composed of, at least in part, a rubber compound and a foaming agent; and a sealing layer disposed on the ballast protection layer.

The aforementioned needs are satisfied in another non-limiting example by a method of coating a bridge deck with a protective coating, the method comprising: applying a waterproof membrane on the bridge deck, wherein the waterproof membrane is applied by spraying the waterproof membrane on the bridge deck; applying a ballast protection layer on the waterproof membrane, wherein the ballast protection coating is applied by spraying the ballast protection coating and a foaming agent on top of the waterproof membrane; and applying a seal coat on the ballast protection coating; wherein the seal coat is applied by spraying the seal coat on the ballast protection coating.

The aforementioned needs are satisfied in another non-limiting example by A system for applying a ballast protection coating to a transportation component, the system comprising: a reservoir for holding particulate rubber; a vacuum system for vacuuming the particulate rubber; a system for supplying a resin; a spray nozzle that simultaneously receives the particulate rubber and the resin and sprays the particulate rubber and resin so as to mix the particulate rubber and resin.

BRIEF DESCRIPTION OF HE DRAWINGS

Certain embodiments of the disclosure will now be discussed in detail with reference to the following figures. These figures are provided for illustrative purposes only, and the disclosure is not limited to the subject matter illustrated in the figures.

FIG. 5 is a perspective schematic view of a system and method of applying a ballast mat cushioning material to a structure such as a railroad bridge or the like.

DETAILED DESCRIPTION OF THE PREFERRED EMBODIMENT

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

The term "mil" and "mils" is used throughout the disclosure as a unit of measurement that refers to a thousandth of an inch. For example, 20 mils refers to 20 thousandths of an inch.

Figure 1:
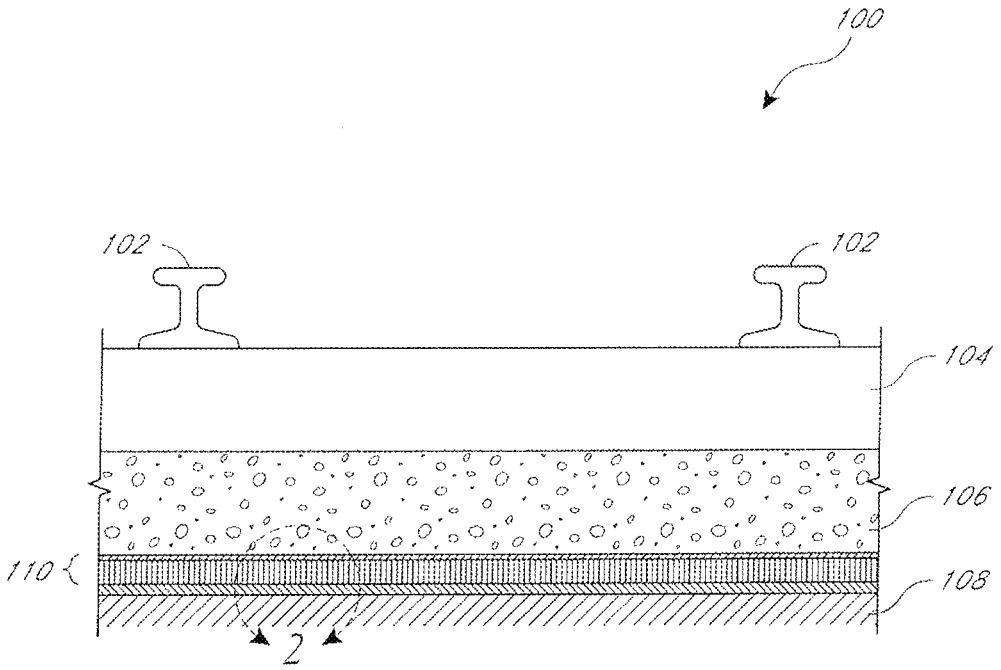
FIG. 1 is a cross-sectional view of one embodiment of a ballast mat installed in a railway bed application.

FIG. 1 illustrates a cross sectional view of one embodiment of a railway track 100. The railway track 100 can include rails 102, railway ties 104, and ballast 106, such as crushed rock or gravel. The rails 102 are installed on the railway ties 104 and positioned on the ballast 106. The railway track 100 is supported on a railway bed 108, such as packed earth, concrete, asphalt, concrete and steel rail bridge structures, tunnels, and other structures. The illustrated embodiment shows one embodiment of a railway system, other railway systems are also contemplated, including railroad, light rail, subway systems, and elevated rail structures. A railway protection system is disposed between the railway bed 108 and the ballast 106. The railway protection system includes a waterproof membrane 116 and an integrated ballast mat 110. Additionally, other transportation structures may benefit from some or all of the teachings of the instant application as will be discussed in greater detail below.

Figure 2:
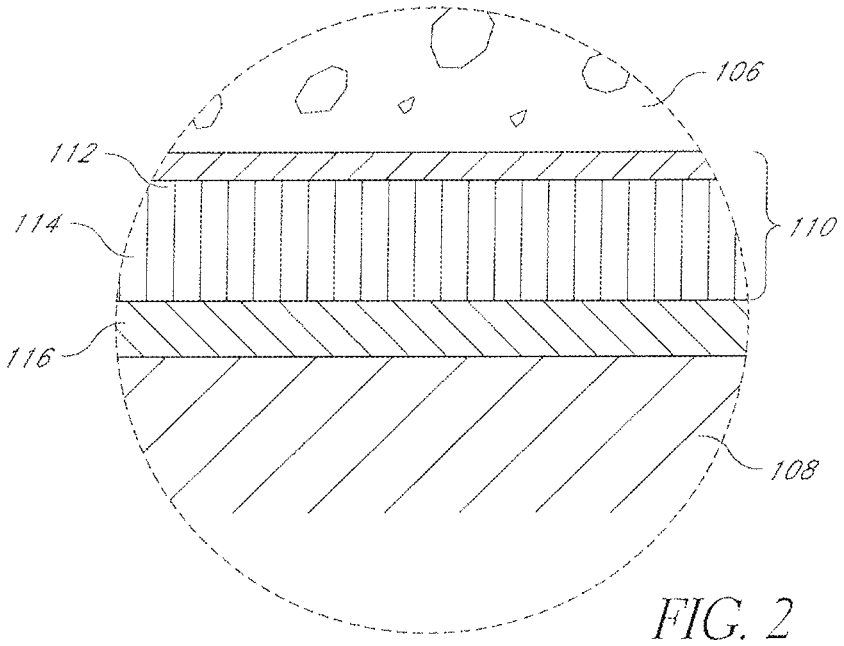
FIG. 2 is a partial section view of an embodiment of a ballast mat illustrated in FIG. 1.

A more detailed view of the railway protection system is illustrated in FIG. 2. The waterproof membrane is applied to the railway bed 108. The waterproof membrane 116 is an elastomeric coating that can be a polyurea, such as Bridge Deck Top Coat™ available from Bridge Preservation a division of Versaflex Inc. of Kansas City, Mo. Preferably, the waterproof membrane 116 is formed from a material that can protect against water, salts, chemicals, and other corrosive elements. The waterproof membrane 116 can be applied by spraying the material while it is in a substantially fluid state. The waterproof membrane 116 can be applied along any length of the railway bed 106. The waterproof membrane 116 can be uniformly applied over irregular surfaces and can be applied horizontally, vertically and overhead. The thickness of each the layer of waterproof membrane 116 can be between 10 and 150 mils thick, and can be between 60 and 120 mils thick. In one embodiment, the waterproof membrane 116 can be 80 mils thick. In some embodiments one or more layers of the waterproof membrane 116 can be applied on top of each other. In one embodiment a first layer of the waterproof membrane 116 is 40 mils thick and a second layer of the membrane 116 is 40 mils thick. The waterproof membrane 116 can be applied so that it has a substantially uniform thickness. In some embodiments the waterproof membrane 116 can be applied having varying thicknesses.

The waterproof membrane 116 can cover all or part of railway bed 108 or other transportation structure. For example on a bridge, the waterproof membrane 116 can cover the entire surface of the bridge deck. In some instances the waterproof membrane will extend out to a predetermined position or location, such as a drainage area. Preferably, the waterproof membrane 116 defines a fluid tight seal on the surface of the railway bed 108 or transportation structure. Preferably, the waterproof membrane 116 can cover the railway bed or transportation structure without seams, which can reduce weak points in the fluid tight seal.

In some embodiments an adhesive or primer layer can be installed (not shown). The adhesive layer can be a primer application and can be applied prior to the placement of the waterproof membrane 110. The adhesive layer can be the same material as all or part of the waterproof membrane 110, such as a polyurea. The adhesive layer can be applied by spraying or rolling the material while it is in a substantially fluid state. In some embodiments the adhesive layer can be between 2 mils and 10 mils thick.

The integrated ballast mat 110 includes a ballast protection coating 114 and a seal coat 112. The ballast protection coating 114 is applied directly to the waterproof membrane 116 and the seal coat is applied to the ballast protection coating 114. The ballast protection coating 114 provides a ballast protection course for the waterproofing membrane 116. The ballast protection coating 114 is an elastomeric coating, which can be composed of a rubber compound, such as styrene-butadiene (SBR) rubber, and resin as well as other materials that will absorb the weight of the train when the train is compressing the ballast. In one specific implementation, a 40 mil layer of resin, then a layer of broadcast rubber or other filler material, then another 40 mil layer of broadcast rubber, then optionally a seal coat can be used to form a coating thicker 250 to 300 mil system. In some embodiments the ballast protection coating 114 can be applied by spraying the material while it is in a substantially fluid state. An example of this application and a system for doing the same will be described in greater detail with respect to FIG. 4 hereinbelow. In other embodiments the ballast protection coating 114 can be broadcast in a dry form, such as ground up tires, and a resin coating applied over the dry layer. The ballast protection coating 114 is applied on top of the waterproof membrane 116. The ballast protection coating 114 can cover substantially all of the waterproof membrane 116. In some embodiments the ballast protection coating 114 covers only a portion of the waterproof coating 114. Preferably, the ballast protection coating 114 covers all of the waterproof membrane 116 where ballast is positioned above the waterproof membrane 116.

One or more layers of the ballast protection coating 114 can be applied. Or, alternatively, repeated layers of resin and filler can then be applied to achieve a desired thickness at which point the seal coat can be applied. The thickness of each the layer of the ballast protection coating 114 can be between 10 and 150 mils thick, and can be between 30 and 50 mils thick. In one embodiment the ballast protection coating 114 has two layers that are 40 mils thick. In another embodiment the ballast protection coating 114 has three layers that are 40 mils thick. In one embodiment, the combined thickness of the layers of the ballast protection coating 114 can be 250 mils. The thicknesses can vary depending upon the application.

The ballast protection coating 114 protects the waterproof membrane 116 from damage caused by operation of the railway as it absorbs the compressive forces of the ballast as the train travels over the structure. The ballast protection coating 114 can also provide additional waterproofing protection. By protecting the waterproof membrane 116, the ballast protection coating 114 protects the underlying structure from water infiltration which can cause corrosion and structural deterioration over prolonged periods of time. Moreover, the resin and filler may also inhibit water intrusion. Preferably, the ballast protection coating 114 can be used for concrete, steel, and other rail structures.

The seal coat 112 is applied to the ballast protection coating 114. The seal coat 112 binds and seals the ballast protection layer 114. The seal coat can be any type of sealant. The seal coat 112 can be applied by spraying the material while it is in a substantially fluid state. The seal coat 112 substantially covers the ballast protection layer 114. The thickness of the seal coat 112 can be between 10 and 150 mils. In one embodiment the seal coat can be 40 mils. In one embodiment the seal coat 112 can be the same material as all or part of the waterproof membrane 116, such as a polyurea. The seal coat can be applied on top of the layers of resin and filler or may also be intermixed in the layers.

The ballast mat 110 and waterproof membrane 116 provide increased dielectric resistance between railway tracks and the underlying railway structure 108. The dielectric resistance helps insulate the underlying railway structure 108 from stray current emanating from the railway tracks, such as light-rail tracks, that can cause accelerated corrosion on unprotected structures. The ballast mat 114 can also dampen noise and vibration that comes from the operation of the railway. The ballast mat can absorb and reduce vibrations that come from the rails through the ballast.

Figure 3:
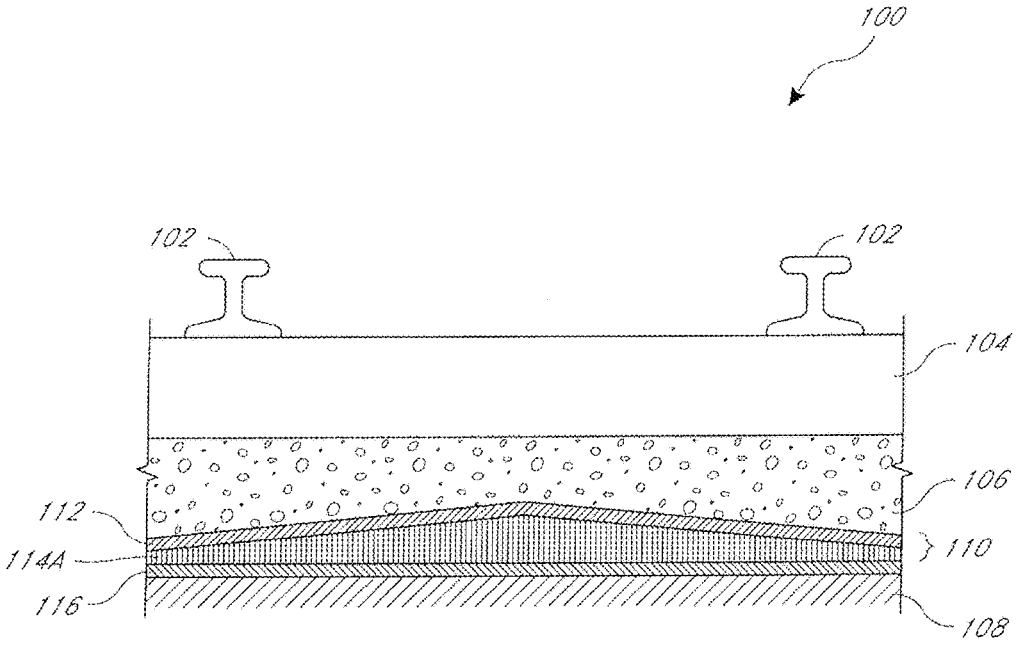
FIG. 3 is a cross-sectional view of another embodiment of a ballast mat installed in a railway bed application.

FIG. 3 illustrates an alternate embodiment of the ballast protection coating 114A. The layers of the ballast protection coating 114A can be applied to shape the profile of the ballast mat 110. Different profiles are formed by applying different numbers of layers of the ballast protection coating 114. In the embodiment in FIG. 3 the ballast protection coating 114A has been formed so that it slopes downward from the apex to the outer edges. The shape of the ballast protection coating 114A can help direct the flow of water down the sides and away from the center of the railway bed 108. The ballast protection coating 114 can be shaped into other profiles depending on the specific application. For example, the ballast protection coating 114 can be applied at varying thickness to provide slop on a flat bridge deck. In another example, the ballast mat 110 can be shaped to direct runoff to a specific location, or the ballast mat 110 can be shaped to avoid pooling of water caused by irregular or uneven surfaces. Illustratively, the ballast protection coating can be applied to irregular or uneven surfaces at varying thicknesses to form level or uniformly sloped surfaces.

Figure 4:
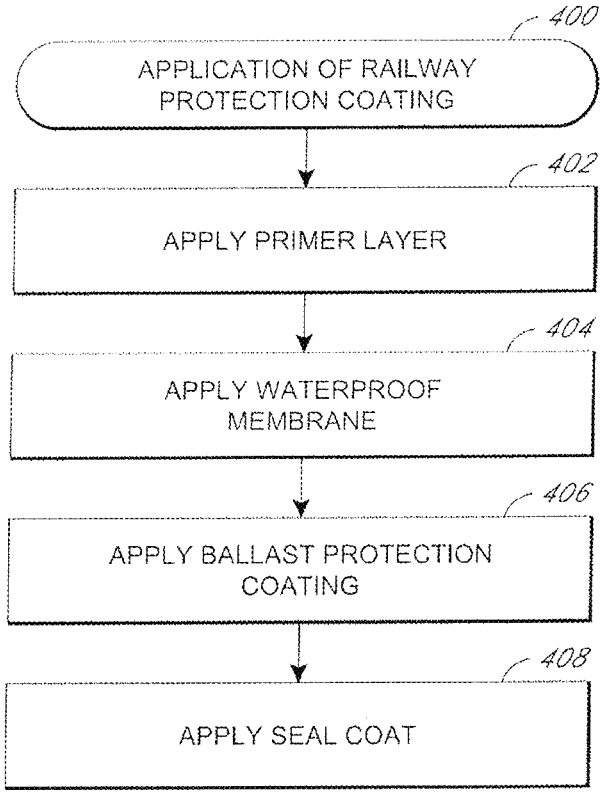
FIG. 4 illustrates an embodiment of a flowchart for a method of applying the railway protection coating to a railway structure.

FIG. 4 is an illustrative flowchart showing the application the railway protection coating to a railway structure 400. At block 402, a primer or adhesive layer can be optionally applied to a railway structure, such as a bridge deck, prior to the application of the waterproof membrane. The adhesive layer can be applied by spraying the primer when it is in a substantially fluid state. The adhesive layer can also be applied by roller or other equipment. In some embodiments the primer can be between 2 mils and 10 mils. The primer can help seal surfaces prior to the application of the waterproof membrane.

At block 404, the waterproof membrane is applied to the railway structure. The waterproof membrane can be applied by spraying the waterproof membrane when it is in a substantially fluid state. The waterproof membrane can be applied as a specified thickness in one continuous application. In one embodiment the waterproof membrane is 80 mils. The waterproof membrane can be used to coat the entire railway structure and can be sprayed horizontally, vertically, and overhead. Preferably the waterproof membrane is applied to provide a continuous seamless waterproofing membrane on the railway structure. Illustratively, on a bridge deck, a substantially uniform waterproof membrane could be applied to the entire bridge deck. Preferably, the waterproof membrane creates a substantially seamless protective coating between the bridge deck and water, salts, chemicals, and other corrosive elements.

At block 406, a ballast protection coating is applied over the waterproof membrane. The ballast protection coating can be applied in one or more layers. The ballast protection coating can be applied by spraying the ballast protection coating when it is in a substantially fluid state. The ballast protection coating provides protection against ballast impact to the waterproof membrane. The ballast protection coating also provides additional seamless waterproofing protection. The ballast protection coating can be applied as a series of layers. The layers can be applied to the railway structure non-uniformly. For example, layers of the ballast protection coating can be applied to shape or slope the surface of the railway structure. The ballast protection coating can also be used to fill in and level uneven and irregular surfaces. In some embodiments the ballast protection coating can be a uniform thickness. In one embodiment the ballast protection coating has a thickness between 230 mils and 260 mils.

At block 408 a seal coat is applied over the ballast protection coating. The seal coat can be applied by spraying the material while it is in a substantially fluid state. The seal coat seals the ballast protection coating and helps create a protective finish coating on the ballast mat. The seal coat can be applied as a substantially uniform layer over the entire ballast protection coating.

Figure 5:
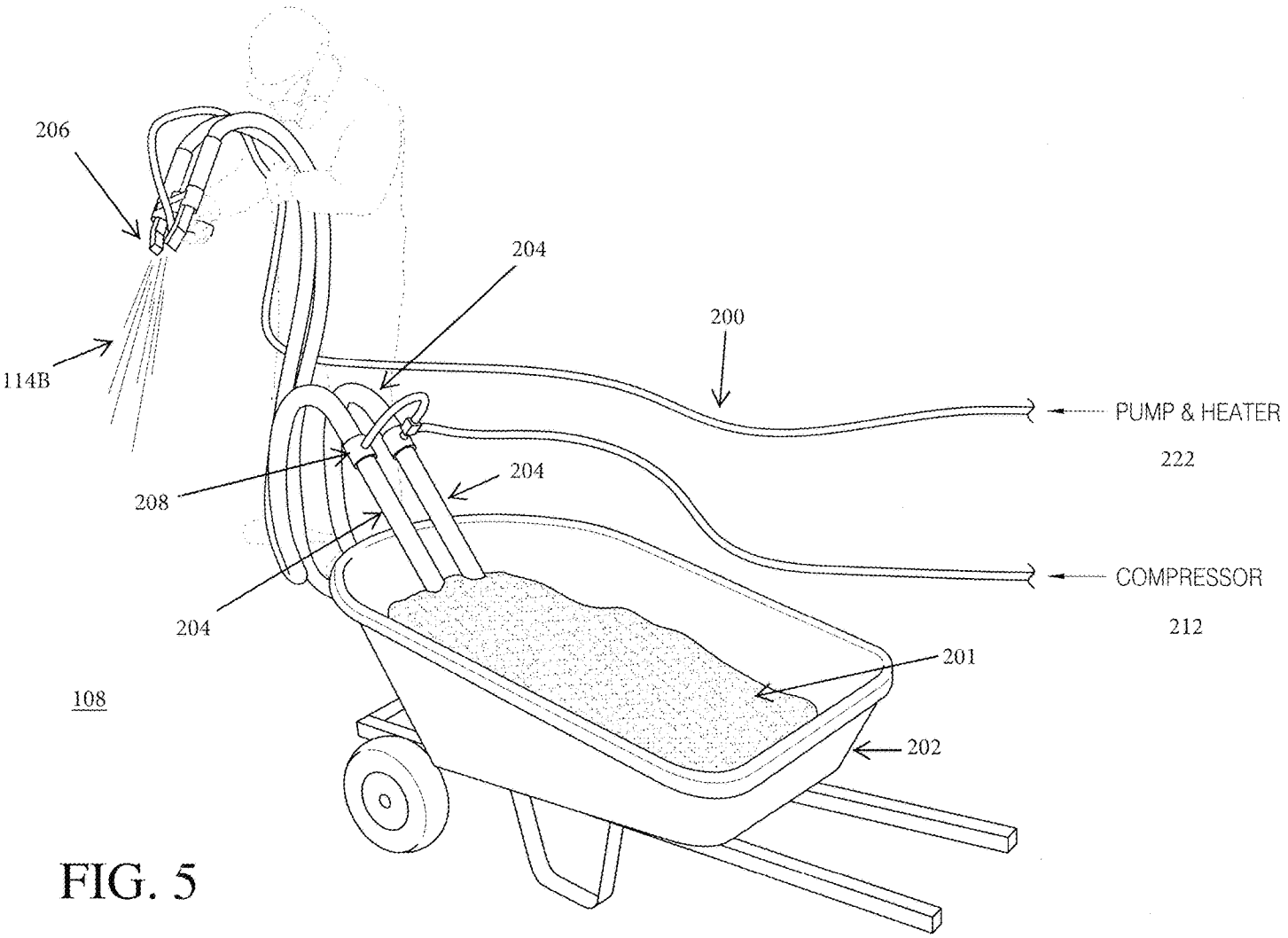
Figure 5A:
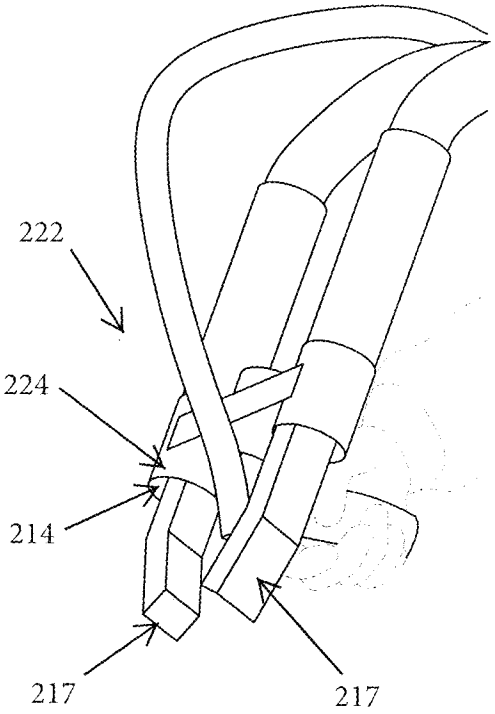
FIG. 5A is a perspective schematic view of a nozzle assembly of the system of FIG. 5.

FIGS. 5 and 5A illustrate a system for applying a ballast protection coating 114B to the transportation structure such as the railroad bridge 108 of FIG. 1 above. As will be discussed in greater detail below, the ballast protection coating 114B can comprise the materials discussed above or it can comprise a newly formulated material described below.

In this implementation, the ballast protection coating 114B is sprayed using the spray apparatus 200 shown in FIG. 5. As shown, the spray apparatus includes a rubber supply hopper 202 that receives nozzles of hoses 204 that are connected to a spray gun 206. The hoses 204 includes venturi valves 208 that are coupled to air hoses 210 that received compressed air from a compressor 212 that blow the compressed air down the hoses 204 towards the spray gun 206. The compressed air in the hoses 206 result in a vacuum force that sucks the rubber material 201 from the supply hopper 202. In one implementation, the compressor is a 100 cfm compressor and the rubber nozzles 214 of the spray gun 206 are 30 cfm nozzles but it will be appreciated that the exact pressures and volumes of rubber being sprayed via the spray gun can vary without departing from the spirit and scope of the instant application.

The system 200 also includes a resin impingement gun apparatus 222 that is integrated into the spray nozzle 206 such that resin is sprayed simultaneously as the rubber particulate material. In one implementation, the resin can comprise a polyuria resin such as the resins described above. In yet another implementation, a foaming agent can be included as will be described below. The resin impingement gun apparatus 222 includes a nozzle 224 that is interposed between the nozzles 214 for the rubber in the gun 206 in the manner shown in FIG. 5A. The nozzles 214 of the rubber preferably include angled guide assemblies 217 are preferably angled such that the two rubber streams are centered about the nozzle 224 of the resin such that the resin and rubber is mixed as the gun 206 is broadcasting the ballast protection coating 114B onto the surface to be coated.

In one implementation, the resign impingement gun apparatus 222 receives a heated resin, an activating compound such as isocynate and a foaming agent from a heating and pump apparatus 226 for the resin that heats the resin to approximately 150 degrees and then pumps the resin into the impingement gun 222 where it is mixed in a known fashion.

In one implementation two materials being mixed includes the polyuria resin and a foaming agent which is then combined with the activating compound immediately prior to the material being sprayed. Since the material is being sprayed, the combined polyuria resin and rubber is more porous when it is deposited. The Applicant has determined that by adding a foaming agent, the voids in the rubber particles and resin can be more fully filled which reduces the intrusion of water into the resin and reduces damage to the ballast pad due to water intrusion and freezing. More particularly, having a foaming agent that can include a foaming catalyst and a water based substance can result in the resin foaming sufficiently that a substantial portion of the interstitial spaces between the rubber particles are filled with the hardened resin which reduces the potential for water intrusion. In one embodiment, the foaming catalyst and water is provided into the mixing chamber where it is then mixed with the activating compound. In one embodiment, the foaming agent and catalyst are selected so as to cause the resin to foam to approximately 50 percent of it's volume.

The foregoing description details certain embodiments. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A protective coating system for a bed of a railway structure having ballast and a railway track structure comprising:

a cure-in-place waterproof membrane configured to be disposed on the bed of the railway; and a cure-in-place ballast protection coating configured to be disposed over the waterproof membrane, wherein the ballast protection coating is compressible; and wherein the thickness of the ballast protection coating is between approximately 200 mils and 300 mils.

2. The coating of claim 1, wherein the ballast protection coating has a variable thickness.

3. The coating of claim 1, further comprising a primer layer, wherein the primer layer is disposed on the railway bed and the waterproof membrane is disposed on the railway bed.

4. The coating system of claim 1, wherein the railway bed is chosen from the group consisting of packed earth, concrete, asphalt, and steel structure.

5. The coating system of claim 1, wherein the railway structure is a bridge structure.

6. The coating system of claim 1, wherein the ballast protection coating comprises a rubber compound that includes styrene-butadiene rubber.

7. The coating system of claim 1, wherein the thickness of the ballast protection coating is greater than the thickness of the waterproof membrane.

8. The coating system of claim 1, wherein the thickness of the waterproof membrane is between approximately 60 mils and 120 mils.

9. The coating system of claim 1, further comprising a sealing layer having a thickness of between 20 mils and 60 mils.

10. The coating system of claim 1, wherein the waterproof membrane and a bottom surface of the ballast protection coating are substantially parallel.

11. The coating system of claim 1, further comprising a seal coating disposed over the ballast protection coating, the seal coating having a substantially uniform thickness.

12. The coating system of claim 1, wherein the ballast protection coating has dielectric properties.

13. The coating system of claim 1, wherein the ballast protection coating forms a substantially seamless coating over the railway bed.

14. The coating system of claim 1, wherein the ballast protection coating covers substantially the entire surface of the railway bed bridge structure.

15. A method of coating a railway bed with the protective coating system of claim 1, the method comprising:

applying the cure-in-place waterproof membrane on the railway bed; and applying the cure-in-place ballast protection coating on the waterproof membrane.

16. The method of claim 15, further comprising applying a primer layer to the railway bed prior to applying the waterproof membrane.

17. The method of claim 15, wherein the ballast protection coating substantially covers the waterproof membrane.

18. The method of claim 15, wherein applying the cure-in-place waterproof membrane includes spraying the waterproof membrane on the railway bed.

19. The method of claim 15, wherein applying the cure-in-place ballast protection coating includes spraying the ballast protection coating on the waterproof membrane.

20. The method of claim 15, wherein applying the cure-in-place ballast protection coating includes adhering the ballast protection coating to the waterproof membrane.

21. The method of claim 15, further comprising applying a seal coating over the ballast protection coating.

* * * * *